US009694417B2

(12) United States Patent
Hernesniemi

(10) Patent No.: US 9,694,417 B2
(45) Date of Patent: Jul. 4, 2017

(54) PIVOTABLE TUNDISH AND A METHOD FOR CONTINUOUS CASTING A METAL ALLOY, USE OF A PIVOTABLE TUNDISH AND AN ELONGATED CAST BAR OF A METAL ALLOY

(76) Inventor: Sarita Hernesniemi, Ulvila (FI)

( * ) Notice: Subject to any disclaimer, the term of this patent is extended or adjusted under 35 U.S.C. 154(b) by 168 days.

(21) Appl. No.: 14/377,326

(22) PCT Filed: Feb. 10, 2012

(86) PCT No.: PCT/EP2012/052336

§ 371 (c)(1),
(2), (4) Date: Aug. 7, 2014

(87) PCT Pub. No.: WO2013/117240

PCT Pub. Date: Aug. 15, 2013

(65) Prior Publication Data

US 2015/0030495 A1 Jan. 29, 2015

(51) Int. Cl.

| | |
|---|---|
| ***B22D 11/00*** | (2006.01) |
| ***B22D 11/10*** | (2006.01) |
| ***B22D 41/04*** | (2006.01) |
| ***B22D 11/103*** | (2006.01) |
| ***B22D 11/116*** | (2006.01) |
| ***B22D 11/14*** | (2006.01) |
| ***B22D 11/108*** | (2006.01) |
| *C22C 9/00* | (2006.01) |

(52) U.S. Cl.

CPC ..... *B22D 11/004* (2013.01); *B22D 11/103* (2013.01); *B22D 11/108* (2013.01); *B22D 11/116* (2013.01); *B22D 11/143* (2013.01); *B22D 41/04* (2013.01); *C22C 9/00* (2013.01)

(58) Field of Classification Search

CPC ..... B22D 11/00; B22D 11/103; B22D 11/108; B22D 11/116; B22D 11/143; B22D 41/04

USPC ..... 164/438, 439, 440

See application file for complete search history.

(56) References Cited

U.S. PATENT DOCUMENTS 2,659,120 A 11/1953 Harter, Jr. et al.
4,125,146 A * 11/1978 Muller ..... B22D 11/118 164/134
4,588,507 A 5/1986 Saudray et al.
(Continued)

FOREIGN PATENT DOCUMENTS

CN 1048671 1/1991
CN 1416375 5/2003
(Continued)

*Primary Examiner* — Kevin P Kerns
(74) *Attorney, Agent, or Firm* — Hodgson Russ LLP

(57) ABSTRACT

A pivotable tundish (1) for continuous casting a metal alloy. The tundish includes a body (3) with a first chamber (5), a second chamber (7), a first passage (12) between the first chamber and the second chamber, and a second passage (16) between the second chamber and a mold (9). The first chamber is adapted to receive and hold a base metal constituting the base for forming the metal alloy by addition of alloying elements. The metal alloy is fed from the second chamber to the mold through the second passage. The second chamber further includes a first portion (30) and a second portion (32), and a third passage (36) between the first portion and the second portion. In the casting state the metal alloy is formed while casting by adding the alloying elements to the second portion of the second chamber.

7 Claims, 4 Drawing Sheets

(56) References Cited

U.S. PATENT DOCUMENTS

| | | | | |
|---|---|---|---|---|
| 2007/0256520 | A1 | 11/2007 | Cheng et al. | |
| 2011/0111301 | A1* | 5/2011 | Rossi | B22D 11/0611 429/225 |

FOREIGN PATENT DOCUMENTS

| | | | |
|---|---|---|---|
| CN | 1658987 | | 8/2005 |
| CN | 101607308 | | 12/2009 |
| JP | 1496901988 | | 5/1990 |
| JP | 1507321989 | | 9/1991 |
| JP | 5-23806 | A | 2/1993 |
| JP | 5-23806 | B | 4/1993 |
| WO | 2005/095027 | A1 | 10/2005 |

* cited by examiner

PIVOTABLE TUNDISH AND A METHOD FOR CONTINUOUS CASTING A METAL ALLOY, USE OF A PIVOTABLE TUNDISH AND AN ELONGATED CAST BAR OF A METAL ALLOY

FIELD OF THE INVENTION

The present invention relates to a pivotable tundish for continuous casting a metal alloy. The tundish comprises a body adapted to be pivoted between a casting state and a non-casting state. The body comprises a first chamber and a second chamber separated from each other, a first passage between the first chamber and the second chamber, and a second passage between the second chamber and a mold for continuous casting the metal alloy. In the non-casting state the first chamber is adapted to receive and hold a base metal in molten condition. The base metal constitutes the base of the metal alloy that is formed by adding one or more alloying elements to the base metal. In the casting state said metal alloy is fed from the second chamber to the mold through the second passage.

The present invention also relates to a method for continuous casting of a metal alloy, use of a pivotable tundish and a cast bar of the metal alloy cast according to the method.

PRIOR ART

In continuous casting of a metal alloy, the metal alloy is formed by alloying a molten base metal with one or more alloying elements, while the tundish is in the non-casting state. The molten base metal is added to the first chamber of the tundish. Thereafter, the correct amount of the one or more alloying elements is added to the base metal resulting in the desired composition of the metal alloy.

The formed metal alloy is thereafter cast by means of pivoting the tundish from the non-casting state to the casting state so that the metal alloy is fed from the first chamber, through the first opening, to the second chamber and from the second chamber, through the second opening, to the mold. In the casting state, the tundish is pivoted so that the metal alloy is fed from the tundish with appropriate speed to supply the mold with the metal alloy, wherein the molten metal alloy solidifies gradually into an elongated cast bar.

A problem in prior art tundish for continuous casting is that it is time consuming to change from casting a first metal alloy with a first composition to a second metal alloy with a second composition, because the chambers of the tundish must be decontaminated from remains of the previous metal alloy prior to casting the second metal alloy in order to avoid impurities in the second metal alloy. The decontamination is of particular importance when the first and the second metal alloy comprise different alloying elements. Due to the time consuming decontamination process between casting different metal alloys, it is necessary to limit the number of different metal alloys used in the tundish in order to obtain sufficient high production rate.

The decontamination of the tundish involves manual and tedious work that may, if not accurately protected, be harmful to the health of the workers. The decontamination process involves removing remains of the first metal alloy from the walls of the chambers and openings. The removal of the remains of the first metal alloy may involve significant quantities of the metal alloy that is scraped. The removed material may also contain significant quantities of alloying elements of high value. Accordingly, the removed metal alloy when decontaminating the tundish therefore adds cost to the final cast metal alloy.

Another problem with prior art tundish is that if the tundish is not properly decontaminated from the first metal alloy, the second metal alloy that is cast will become contaminated, which may influence the properties of the second metal alloy or the second metal alloy will be out side that the manufacturing specification range. If contamination of elements is present in the second metal alloy from previous casting, it may be necessary to scrap the whole or part of the cast metal alloy. This is in particular a problem, when various types of copper alloys are to be produced by continuous casting, such as copper alloyed with silver, tin, zinc, etcetera, where the base material of copper must be of high purity to provide the desired properties to the final cast metal alloy.

U.S. Pat. No. 4,830,090 discloses a tundish comprising three chambers where alloying elements are added to a central located chamber.

JP56009049 discloses a tundish comprising two chambers where alloying elements are added to one of the chambers.

JP5023806 discloses a tundish comprising a plurality of chambers where alloying elements are added to the chambers while casting.

OBJECTS AND SUMMARY OF THE INVENTION

The object of the present invention is to provide an improved tundish and method for continuous casting a metal alloy. A first object of the invention relates to a tundish and method with improved flexibility of changing between casting different metal alloys in comparison to prior art. A second object of the invention relates to a tundish and method that require less or no manual decontamination when changing between casting different metal alloys. A third object of the invention relates to a tundish and method that reduces the amount of scraped material of the metal alloy and waste of the one or more alloying elements.

These objects are obtained with a pivotable tundish. The pivotable tundish is characterized in that the second chamber further comprises a first portion to which the first passage is connected and a second portion to which the second passage is connected, which first portion and second portion are separated from each other, and a third passage between the first portion and the second portion, wherein the metal alloy is adapted to be formed when the tundish is in the casting state in that the base metal from the first chamber is fed from the first chamber to the first portion through the first passage and from the first portion to the second portion through the third passage while adding the one or more alloying elements to the second portion of the second chamber.

By means of adding the one or more alloying elements to the second portion of the second chamber while the tundish is in the casting state the base metal and the one or more alloying elements form the metal alloy while casting the metal alloy. The first portion of the second chamber acts as a diffusion barrier for assuring that the base metal in the first chamber is not contaminated by the alloying elements added in the second portion of the second chamber.

When terminating the casting or when refilling of the base metal in the first chamber is necessary, the addition of the alloying elements is adapted to be stopped prior to pivoting the tundish from the casting state to the non-casting state. Thereby, the alloying elements are rinsed out prior to pivoting the tundish from the casting state to the non-casting state, and accordingly the purity of the base metal in the first chamber is maintained unaffected regardless of which metal alloy that is being cast.

In that the purity of the base metal in the first chamber is assured, the flexibility of the tundish is improved so that casting quickly and easy can be switched between different metal alloys using same base metal without the necessity of decontaminating the chambers of the tundish.

The same base metal is usable for a casting a large number of different metal alloys without requiring decontamination of the tundish. When casting different metal alloys, the claimed tundish provides an improved production rate in comparison to prior art tundishes in that the time for changing between different metal alloys is minimized. The tundish is in particular useful when casting many different metal alloys from the same base metal.

A small amount of scrap material is produced at the start and termination of the casting of the metal alloy. The amount is however considerably less than what is produced in prior art tundishes. Accordingly, the claimed tundish improves the flexibility of casting different metal alloys that all are based on the same base metal and reduces the amount of scrap material, in particular, scrap material comprising valuable alloying elements. Thereby, the operation cost of casting using the claimed tundish is reduced in comparison to prior art.

The term "non-casting state" refers to a state in which the tundish is in an orientation where the base metal is prevented from being displaced away from the first chamber.

The term "casting state" refers to a state in which the tundish is in an orientation where the base metal is fed by gravity from the first chamber to the second chamber and forming the metal alloy in the second portion of the second chamber before being fed to the mold.

According to one embodiment of the invention, the tundish comprises a pivoting arrangement for pivoting the body of the tundish between the casting state and the non-casting state that relate to different orientations of the tundish.

The pivoting arrangement allows the orientation of the tundish to be adjusted in order to adjust the tundish between the casting state and the non-casting state. In the casting state the second passage is extending in direction of the mold. In the non-casting state the second passage is extending away from the mold.

According to one embodiment of the invention, the tundish comprises a supply arrangement for supplying the one or more alloying elements to the base metal, which supply arrangement is directed so that the alloying elements are fed into the second portion of the second chamber.

The supply arrangement is adapted to regulate the addition of the one or more alloying elements that is provided to the base metal in order to form the metal alloy according the specified composition. The supply arrangement preferably provides the one or more alloying elements in the form of powder or granules in order to assure that the composition of the metal alloy becomes homogeneous.

According to one embodiment of the invention, the body of the tundish comprises a first wall section provided with the first passage, a second wall section provided with the second passage and a third wall section provided with the third passage, wherein the wall sections are arranged so that the first wall section separates the first chamber from the first portion of the second chamber, the second wall section separates the second portion of the second chamber from the mold, and the third wall section separates the first portion from the second portion of the second chamber.

The wall sections provide barriers for the base metal and the metal alloy. The passages in the wall sections extend so that the base metal and the metal alloy are fed in direction of the mold when the tundish is in the casting state and so that the base metal and the metal alloy are prevented from being fed to the mold when the tundish is in the non-casting state.

According to one embodiment of the invention, the second passage is oriented so to enable continuous horizontal casting of the metal alloy. The second passage is leading to an opening that is adapted, when the tundish is in the casting state, to be arranged in connection to a corresponding opening in the mold for casting the metal alloy.

According to one embodiment of the invention, the tundish comprises heating means for heating the base metal and/or the metal alloy. Preferably, the heating means for heating the base metal and/or the metal alloy comprises an induction heating device arranged in a lower part at least one of the first chamber and second chamber. By means of the heating means, heat is added so that it is assured that the base metal and/or the metal alloy remains in the molten state while being contained in the tundish.

According to one embodiment of the invention, at least one of the first passage, the second passage and the third passage comprises a plurality of through holes in the corresponding wall section. By means of the plurality of holes in the corresponding wall, the feeding of the base metal and/or the metal alloy is conducted with an essentially constant flow rate.

According to one embodiment of the invention, the volume of the second chamber is smaller than the first chamber. The first chamber acts as a reservoir for the base metal. The second chamber provides a separate compartment for forming the metal alloy and for providing the metal alloy with an appropriate rate to the mold for continuous casting of the metal alloy.

The above mentioned objects are further obtained by means of a method for continuous casting a metal alloy. The method comprises the steps of

- pivoting the body of the tundish to the non-casting state,
- adding the base metal to the first chamber when the tundish is in the non-casting state,
- pivoting the body of the tundish from the non-casting state to the casting state, and thereby casting the base metal,
- subsequent to casting the base metal, adding the one or more alloying elements to the base metal in the second portion of the second chamber so that metal alloy is formed, and thereby casting the metal alloy.

According to one embodiment of the invention, the method further comprises

- casting the base metal during a first certain period prior to the addition of the one or more alloying elements to the base metal.

According to one embodiment of the invention, the method further comprises:

- stopping the addition of the one or more alloying elements to the base metal in the second portion of the second chamber,
- continue casting subsequent to stopping the addition of the one or more alloying elements to the base metal until only casting the base metal,
- pivoting the body of the tundish from the casting state to the non-casting state, and thereby stop casting.

According to one embodiment of the invention, the method comprises continue casting subsequent to stopping the addition of the one or more alloying elements during a second certain period.

According to one embodiment of the invention, the base metal comprises a single metal element or a mixture of two or more metal elements.

According to one embodiment of the invention, the one or more alloying elements have a melting point that is lower than the melting point of the base metal.

According to one embodiment of the invention, the base metal comprises mainly copper and the one or more alloying element comprises at least one of silver, tin, zinc, and alloys thereof.

According to one embodiment of the invention, the method comprises casting the metal alloy in the form of an elongated cast bar.

According to one embodiment of the invention, the elongated cast bar comprises a first end part relating to a start-up phase of the casting of the metal alloy and a second end part relating to a shut-down phase of the casting of the metal alloy, wherein the method further comprises:

removing at least one of the first end part and the second end part of the cast bar.

The invention further relates to use of a tundish and an elongated cast bar.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1:
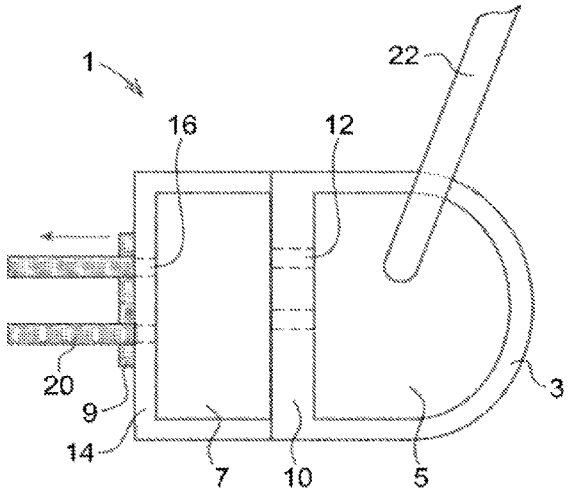
Fig. 1 (Prior Art)
FIG. 1 shows an example of a prior art pivotable tundish for continuous casting of a metal alloy seen from a top view.

FIG. 1 shows a prior art pivotable tundish 1 for continuous casting of a metal alloy. The tundish 1 comprises a body 3 comprising a first chamber 5 and a second chamber 7 separated from each other by a first wall section 10.

The first chamber 5 is adapted to receive a base metal in a molten state and one or more alloying elements, wherein the metal alloy is formed in the first chamber 5. The first wall section 10 is provided with a first passage 12. In the disclosed embodiment the first passage 12 comprises two openings in the first wall section 10 for enabling the metal alloy to be fed from the first chamber 5 to the second chamber 7.

The tundish 1 further comprises a mold 9 for continuous casting of a metal alloy and a second wall section 14 comprising a second passage 16 for enabling the metal alloy to be fed from the second chamber 7 to the mold 9. The second passage 16 comprises in the disclosed example two openings in the second wall section 14.

The tundish 1 is adapted to be pivoted between a casting state and a non-casting state. In the non-casting state the tundish 1 is oriented so to prevent the metal alloy from being fed by gravity from the first chamber 5 to the mold 9 via the second chamber 7. In the casting state the tundish 1 is oriented so that the metal alloy is being fed by gravity from the first chamber 5 to the mold 9 via the second chamber 7, and accordingly the metal alloy is cast into one or more cast bars 20. The cast bars 20 are cast in a horizontal cast direction indicated by the arrow. In the disclosed example two cast bars 20 are cast by means of the mold 9.

In the prior art tundish 1 in FIG. 1, the metal alloy is cast by means of firstly orienting the tundish 1 in the non-casting state and filing the first chamber 5 with the base metal in a molten condition. The base metal constitutes the main part of the metal alloy that is formed by adding the one or more alloying elements to the base metal in the first chamber 5.

The tundish 1 further comprises a supply arrangement 22 for supplying the one or more alloying elements to the base metal. The supply arrangement 22 in the prior art example of the tundish 1 is directed so that the one or more alloying elements are fed into the first chamber 5. By means of adding the one or more alloying elements to the base metal the metal alloy is formed. After that the metal alloy has been formed the tundish 1 pivoted from the non-casting state to the casting state, thereby feeding the metal alloy from the first chamber 5 to the second chamber 7, and from the second chamber 7 to the mold 9, wherein the metal alloy is cast into the cast bars 20.

A problem with the prior art tundish 1 is that the tundish 1 must be decontaminated from the first metal alloy before casting a second metal alloy, which second metal alloy has a different composition than the first metal alloy. Thereby, it is time consuming to cast a plurality of different metal alloys. When the tundish 1 runs low on the metal alloy and needs to be refilled, careful calculation in necessary in order to assure that the correct amount of the one or more alloying elements are added to the first chamber 5 in order to produce the same composition of the metal alloy. This calculation is based on the estimated remains of the metal alloy and the amount of added base metal. Furthermore, the decontamination may involve scraping considerable amounts of the one or more alloying elements. Accordingly the productivity of casting using the prior art tundish 1 is relatively low and the cost of scraping valuable alloying elements high.

Figure 2:
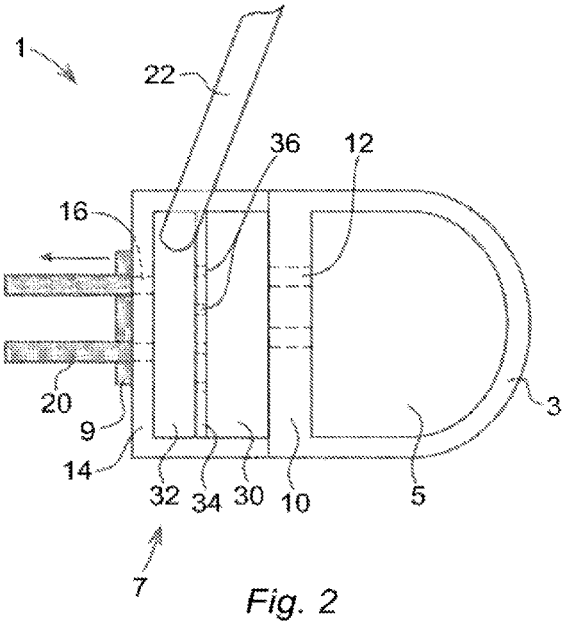
FIG. 2 shows a pivotable tundish for continuous casting of a metal alloy according to an embodiment of the invention seen from a top view.

FIG. 2 discloses a pivotable tundish 1 for continuous casting of a metal alloy according to an embodiment of the invention. The tundish 1 of the invention differs from the prior art tundish 1 in that the second chamber 7 comprises a first portion 30 to which the first passage 12 is connected and a second portion 32 to which the second passage 16 is connected. The first portion 30 and the second portion 32 are separated from each other by means of a third wall section 34. The third wall section 34 is provided with a third passage 36 between the first portion 30 and the second portion 32. In the disclosed embodiment in FIG. 2 the third passage 36 comprises four openings in the third wall section 34.

The tundish 1 further comprises the supply arrangement 22 for supplying the one or more alloying elements to the base metal. In the tundish 1 of the invention, the supply arrangement 22 is directed into the second portion 32 of the second chamber 7, wherein the alloying elements are adapted to be fed into the second portion 32 of the second chamber 7 while the tundish 1 is oriented in the casting state. Accordingly, the metal alloy is formed in the second portion 32 while casting the metal alloy. Thereby, the purity of the base metal in the first chamber 5 is assured. The purity of the base metal in the first chamber 5 is further guaranteed by means of that the first portion 30 between the second portion 32 and the first chamber 5 acts as a diffusion barrier for contamination of the base metal with the one or more alloying elements.

The metal alloy is adapted to be formed when the tundish 1 is in the casting state in that the base metal is fed from the first chamber 5 to the first portion 30 through the first passage 12 and from the first portion 30 to the second portion 32 through the third passage 36 while the one or more alloying elements are added to the second portion 32 of the second chamber 7. The metal alloy formed in the second portion 32 of the second chamber 7 is fed from the second portion 32 by means of the second passage 16 in the second wall section 14 to the mold 9, and thereby casting the metal alloy into the cast bars 20.

When terminating the casting of the metal alloy, firstly the addition of the one or more alloying elements to the second portion 32 is stopped, and secondly after a second certain period the tundish 1 is pivoted from the casting state to the non-casting state.

By means of a tundish 1 according to the invention, the purity of the base metal in the first chamber 5 can be assured. Thereby, it is possible to cast a large number of different metal alloys that uses the same base metal with addition of different amounts of the one or more alloying elements. Accordingly the flexibility of use of the tundish 1 is improved.

The base metal consists of one metal element or a mixture of two or more metal elements. Preferably, the one or more metal alloys each has a melting point that is lower than the melting point of the base metal.

The tundish 1 has shown to be of particular advantage when casting copper alloys, such as copper silver alloys. The amount of silver used in the casting process has a significant influence on the cost of the cast metal alloy. Accordingly, the amount of silver in the scraped metal alloy adds significant cost to the casting process. Furthermore, the value of copper used as the base metal in highly dependent its purity. Accordingly, a small contamination of the base metal will render the base metal non-usable for subsequent casting and accordingly also its metal value will be decreased. The invention offers a solution to this problem by means of the claimed invention.

Figure 3:
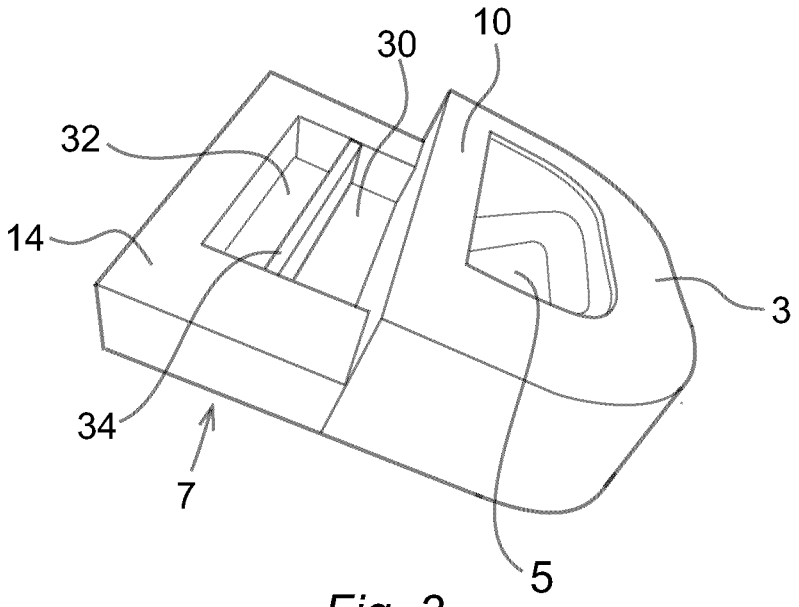
FIG. 3 shows side view of the pivotable tundish in FIG. 2 in a non-casting state.

FIG. 3 shows the tundish 1 in FIG. 2 from a side view in the non-casting state. The tundish 1 is oriented so that the base metal is prevented from being fed by gravity from the first chamber 5 to the second chamber 7. Accordingly the base metal in the first chamber 5 is prevented from being contaminated with the one or more alloying elements. Thereby, the tundish 1 is ready for casting various metal alloys having different compositions based on the same base metal.

Figure 4:
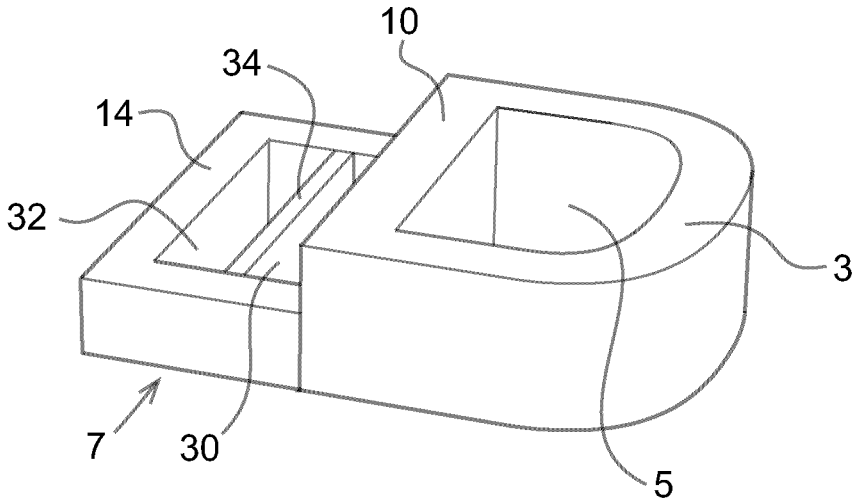
FIG. 4 shows side view of the pivotable tundish in FIG. 2 in a casting state.

FIG. 4 discloses the tundish 1 oriented in the casting state. The base metal is fed by gravity from the first chamber 5 to the first portion 30, and from the first portion 30 to the second portion 32. In the second portion 32 the one or more alloying elements are added to the base metal, and thereby forming the metal alloy. The formed metal alloy is fed by gravity from the second portion 32 to the mold 9 (not disclosed), and thereby casting the metal alloy into one or more cast bars 20.

Figure 5:
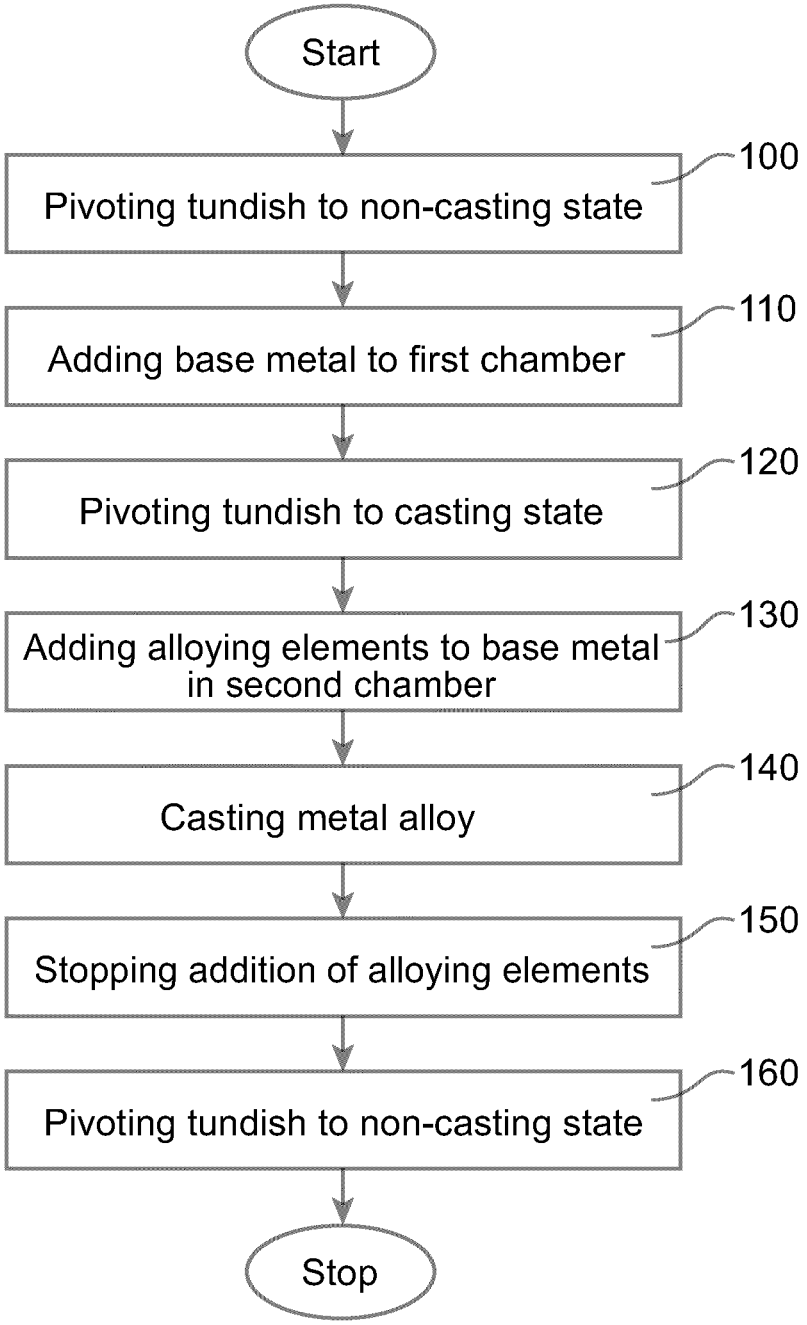
FIG. 5 shows a flow chart of a method for continuous casting a metal alloy according to a first embodiment of the method.

FIG. 5 shows a flow chart of a method for continuous casting a metal alloy by means of the tundish 1. In a step 100, the method comprises setting the tundish 1 into the non-casting state by means of if necessary pivoting the tundish 1 to the orientation of the non-casting state.

The method comprises, In a step 110, adding a base metal to the first chamber 5 when the tundish 1 is in the non-casting state. Thereby the base metal is maintained in the first chamber 5 without risk of being contaminated by alloying elements.

In a step 120, the method comprises pivoting the tundish 1 from the non-casting state to the casting state. Thereby, the base metal is fed by gravity to the second chamber 7 and to the mold 9, wherein the base metal is being cast by the mold 9.

In a step 130, subsequent to casting the base metal, adding one or more alloying elements to the base metal in the second chamber 7 so that the metal alloy is formed. Thereby, in a step 140, the formed metal alloy is fed to the mold 9, wherein the metal alloy is being cast by the mold 9. Thereby, one or more cast bars 20 are being cast from the metal alloy.

When sufficient amount of the metal alloy has been cast or when the amount of base metal in the first chamber 5 is almost finished, the casting of the metal alloy needs to be terminated. The termination of casting of the metal alloy is performed by means of, in a step 150, stopping the addition of the one or more alloying elements to the base metal in the second chamber 7. Thereby, the formation of the metal alloy is terminated and gradually the base metal will be cast. The method further comprises in a step 160, pivoting the tundish 1 from the casting state to the non-casting state. Thereby, the casting of the base metal is stopped and the remaining base metal in the first chamber 5 is maintained in the first chamber 5.

By means of the disclosed method of casting the metal alloy, it is assured that the base metal is maintained essentially uncontaminated from the one or more alloying elements when casting the metal alloy. The method and the tundish 1 has the advantage that a large number of different metal alloys can be cast from a single base metal without the necessity to decontaminate the tundish 1 prior to each new casting of metal alloy. The method has further the advantage that the first chamber is maintained uncontaminated from the one or more alloying elements.

Figure 6:
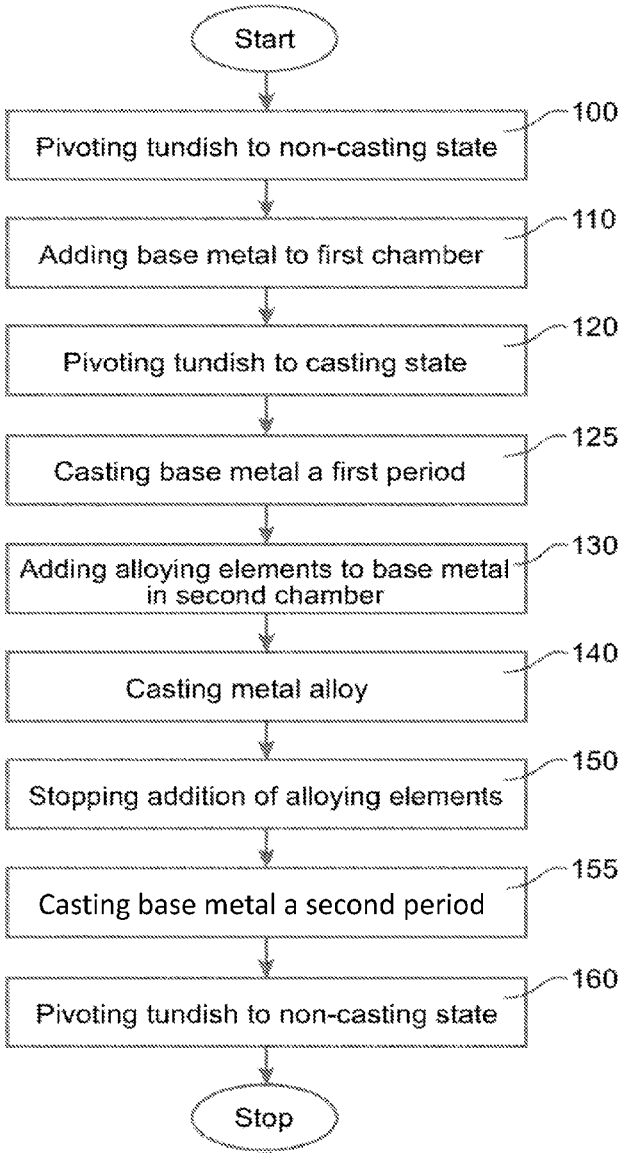
FIG. 6 shows a flow chart of a method for continuous casting a metal alloy according to a second embodiment of the method.

FIG. 6 discloses a method for continuous casting the metal alloy according to a second embodiment of the invention. The second embodiment differs from the first embodiment in the addition of, in a step 125, casting the base metal a first period before in step 130 adding the one or more alloying elements to the base metal in the second chamber 7. By means of casting the base metal the first period prior to adding the alloying elements, the flow rate of the base metal is stabilized prior to the formation of the metal alloy.

The second embodiment further comprises in a step 155, casting the base metal a second period before in step 160, pivoting the tundish 1 from the casting state to the non-casting state, and thereby terminating the casting. By means of casting the second period before pivoting the tundish 1 from the casting state to the non-casting state, it is assured that the added one or more alloying elements are flushed out from the second chamber 7, and thereby the purity of the base metal in the first chamber 5 is assured.

In a further embodiment, the method comprises adding further base metal to the first chamber 5 while the tundish 1 is in the casting state. This is achieved by means of that the first chamber 5 has an opening directed away from the casting direction. Accordingly, further base metal may be added while casting the metal alloy, and thereby avoiding interruption of the casting of the metal alloy.

The method produces one or more cast bars 20 of the metal alloy. The cast bar 20 comprises a first end part relating to a start-up phase and a second end part relating to a shut-down phase of the casting of the metal alloy. The start-up phase and shut-down phase may involve a variation on the composition of the first end part and the second end part of the metal alloy.

The method further comprises the step of cutting off at least one of the ends of the cast bar 20. Thereby, parts of the cast bar 20 of the metal alloy relating to at least one of the start-up phase and shut-down phase of the cast bar 20 is removed.

The present invention is not limited to the embodiment disclosed but may be varied and modified within the scope of the following claims.

The invention claimed is:

1. A pivotable tundish for continuous casting of a metal alloy, the tundish comprising a body adapted to be pivoted between a casting state and a non-casting state, the body comprising a first chamber and a second chamber separated from each other, a first passage between the first chamber and the second chamber, and a second passage between the second chamber and a mold for continuous casting of the metal alloy, wherein the body of the tundish comprises a first wall section provided with the first passage, wherein in the non-casting state the first chamber is adapted to receive and hold a base metal in molten condition that constitutes a base of the metal alloy that is formed by adding one or more alloying elements to the base metal, wherein the first passage is positioned in the first wall section such that the metal alloy is fed from the first chamber to the second chamber only in the casting state and such that the metal alloy is contained only in the first chamber in the non-casting state, wherein in the casting state the metal alloy is fed from the second chamber to the mold through the second passage, characterized in that the second chamber further comprises a first portion to which the first passage is connected and a second portion to which the second passage is connected, wherein the first portion and the second portion are separated from each other, a second wall section is provided with the second passage, and a third wall section is provided with a plurality of third passages between the first portion and the second portion, wherein the first, second, and third wall sections are arranged so that the first wall section separates the first chamber from the first portion of the second chamber, the second wall section separates the second portion of the second chamber from the mold, and the third wall section separates the first portion from the second portion of the second chamber, wherein the first wall section, the second wall section, and the third wall section each have a top surface opposite a base of the tundish, wherein the top surface of the first wall section extends to a point above the top surfaces of the second wall section and the third wall section, wherein the metal alloy is adapted to be formed when the tundish is in the casting state in that the base metal from the first chamber is fed from the first chamber to the first portion through the first passage and from the first portion to the second portion through the third passages while adding the one or more alloying elements to the second portion of the second chamber.

2. The pivotable tundish according to claim 1, wherein the tundish further comprises a pivoting arrangement for pivoting the body between the casting state and the non-casting state, and wherein the casting state and the non-casting state comprise different orientations of the tundish.

3. The pivotable tundish according to claim 1, wherein the tundish further comprises a supply arrangement for supplying the one or more alloying elements to the base metal, which supply arrangement is directed so that the alloying elements are fed into the second portion of the second chamber.

4. The pivotable tundish according to claim 1, wherein the second passage extends so as to enable continuous horizontal casting of the metal alloy.

5. The pivotable tundish according to claim 1, wherein the tundish further comprises heating means for heating the base metal and/or the metal alloy.

6. The pivotable tundish according to claim 1, wherein at least one of the first passage and the second passage comprises a plurality of through holes in a corresponding wall section.

7. The pivotable tundish according to claim 1, wherein the volume of the second chamber is smaller than the first chamber.

* * * * *